US007269978B2

(12) United States Patent
Giro Amigo

(10) Patent No.: US 7,269,978 B2
(45) Date of Patent: Sep. 18, 2007

(54) MESH FOR BAGS OR PACKAGING

(75) Inventor: Ezequiel Giro Amigo, Badalona (ES)

(73) Assignee: Giro GH, S.A., Badalona (ES)

( * ) Notice: Subject to any disclaimer, the term of this patent is extended or adjusted under 35 U.S.C. 154(b) by 0 days.

(21) Appl. No.: 11/455,086

(22) Filed: Jun. 19, 2006

(65) Prior Publication Data

US 2007/0000288 A1 Jan. 4, 2007

(30) Foreign Application Priority Data

Jun. 20, 2005 (ES) ..... 200501494

(51) Int. Cl.
*D04B 25/02* (2006.01)
*D04B 21/00* (2006.01)

(52) U.S. Cl. ..... 66/195; 66/81

(58) Field of Classification Search ..... 66/79–81, 66/169 R, 170, 192, 193, 195
See application file for complete search history.

(56) References Cited

U.S. PATENT DOCUMENTS

| | | | | | |
|---|---|---|---|---|---|
| 2,263,787 | A | * | 11/1941 | Safferson | 66/170 |
| 3,513,668 | A | * | 5/1970 | Mintz | 66/193 |
| 3,866,444 | A | * | 2/1975 | Levin | 66/195 |
| 3,981,415 | A | * | 9/1976 | Fowler et al. | 66/193 |
| 4,052,866 | A | * | 10/1977 | Saunders | 66/193 |
| 4,055,201 | A | * | 10/1977 | Fowler et al. | 66/193 |
| 4,781,039 | A | * | 11/1988 | Ribarev et al. | 66/192 |

FOREIGN PATENT DOCUMENTS

| | | |
|---|---|---|
| DE | 10 2005 006 110 A1 | 8/2006 |
| EP | 1 010 792 B1 | 9/2003 |
| FR | 2 061 251 A | 6/1971 |
| FR | 2 225 560 A | 11/1974 |
| GB | 1 207 030 A | 9/1970 |
| GB | 1 474 228 A | 5/1977 |

OTHER PUBLICATIONS

European Search Report for EP 06 38 0147 dated Sep. 11, 2006.

* cited by examiner

*Primary Examiner*—Danny Worrell
(74) *Attorney, Agent, or Firm*—Sughrue Mion, PLLC

(57) ABSTRACT

The invention relates to a mesh for bags or packaging, produced by knitting technology by warping in a circular loom of simultaneous mesh formation. The mesh constitutes a uniform tubular mesh structure wherein the warp yarns or bands form mesh chains parallel to the longitudinal axis of the tubular mesh and the weft yarns or bands perpendicular to said axis are interwoven between at least two adjacent mesh chains so that each weft yarn or band traverses the meshes of said chains, constituting a uniform tubular mesh without longitudinal seams or perpendicular mesh bonds.

21 Claims, 3 Drawing Sheets

MESH FOR BAGS OR PACKAGING

TECHNICAL FIELD OF THE INVENTION

The present invention relates to a mesh of the type used to produce bags or packaging which contain food products such as citrus fruits, potatoes, etc.

BACKGROUND OF THE INVENTION

At present, bags comprised of a tubular mesh body of heat-sealable material, closed at their ends by sheets of heat-sealable material, a staple, hoop or any other closing system, are widely used. These bags are frequently used to commercialise determined food products, especially fruit and vegetables, since, unlike conventional plastic bags, they allow the product to breath and extend their preservation time and enable the buyer to inspect the product contained in the bag visually, tactilely or by smell.

Document ES 2 154 197 B1 discloses a tubular elastic knitted fabric of thermoplastic polymer and a process to produce it, wherein the bands are knitted to form a tubular mesh structure which has mesh chains parallel to the longitudinal axis of tubular fabric, and bands perpendicular to said axis which join the mesh chains together. For their part, the mesh chains parallel to the longitudinal axis are formed by two types of bands, some that are only woven in said chains, and others that are perpendicular to the longitudinal axis and which join the meshes together.

Nevertheless, the lack of a mesh is felt which involves the use of less quantity and length of bands for the same weight or format of bag or packaging, which is resistant, simple and advantageously economic to produce.

EXPLANATION OF THE INVENTION

With the object of providing a solution to the problem posed, a new mesh for bags or packaging is disclosed.

In essence, mesh for bags or packaging is characterized in that it is produced by knitting technology by warping in a circular loom of simultaneous mesh formation, forming a uniform tubular mesh structure wherein the warp yarns or bands form mesh chains parallel to the longitudinal axis of the tubular mesh and the weft yarns or bands perpendicular to said axis are interwoven between at least two adjacent mesh chains so that each weft yarn or band traverses the meshes of said chains, forming a uniform tubular mesh without longitudinal seams or perpendicular mesh bonds throughout the structure.

According to another characteristic of the invention, the warp yarns or bands of the mesh chains have characteristics and physical properties different to those of the weft yarns or bands.

In accordance with another characteristic of the invention, the warp yarns or bands of the mesh chains are made of a different material from the weft yarns or bands.

BRIEF DESCRIPTION OF THE DRAWINGS

The attached drawings illustrate, by way of non-limiting example, a preferred embodiment of the mesh for bags or packaging object of the invention. In said drawings.

DETAILED DESCRIPTION OF THE DRAWINGS

Figure 1:
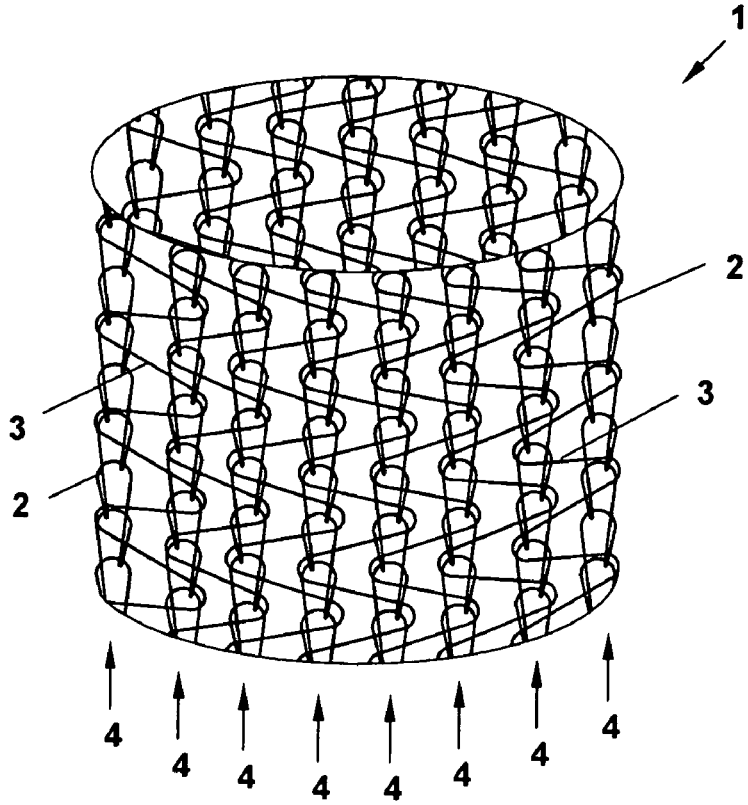
FIG. 1 is a perspective view of the mesh object of the invention.

FIG. 1 shows the tubular mesh 1 for bags or packaging. This mesh 1 is produced by knitting technology by warping in a circular loom of simultaneous mesh formation.

Figure 2:
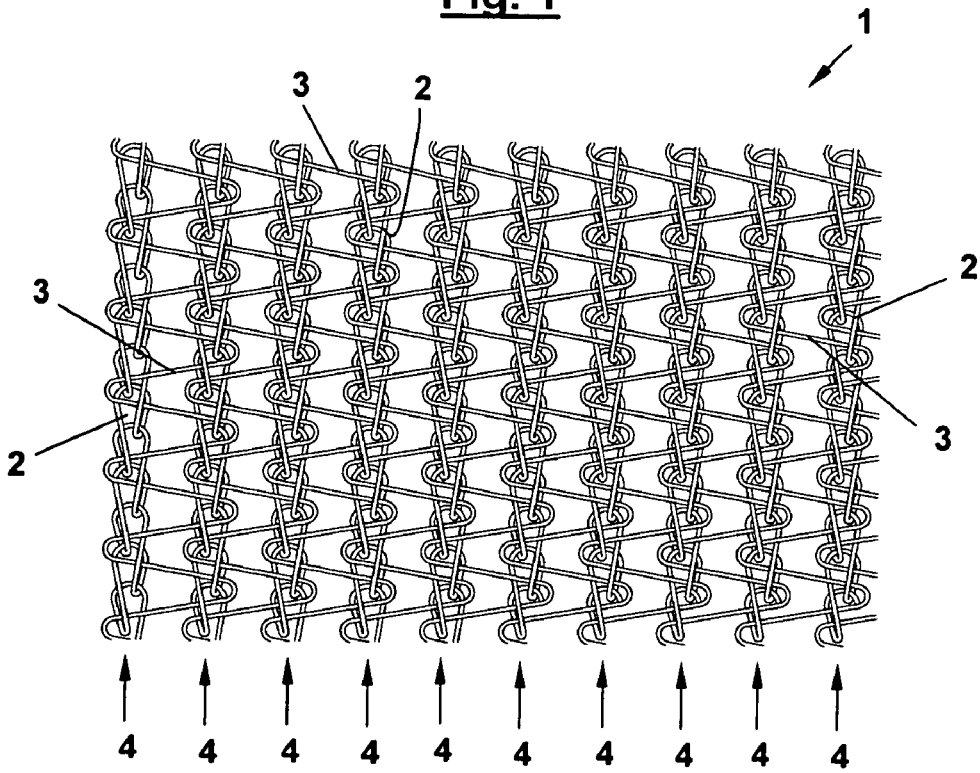
FIG. 2 is an elevational view of a portion of the mesh of FIG. 1.

With the object of facilitating the understanding of the tubular mesh structure 1 of FIG. 1, FIG. 2 represents a portion thereof with the appearance the mesh 1 would have if it were flattened. The drawing shows that the warp yarns or bands 2 form mesh chains 4 parallel to the longitudinal axis of the tubular mesh, whilst the weft yarns or bands 3 perpendicular to said axis are interwoven between two adjacent mesh chains. In this way, each weft yarn or band 3 traverses the meshes of two adjacent mesh chains 4, making a weft bond between the two mesh chains 4, wherein the weft band 3 is simply inserted in the meshes of the chains 4 that form the warp yarns or bands 2.

It should be highlighted that, in the mesh 1, the bond made between two adjacent mesh chains 4 is not a mesh bond wherein the weft yarns or bands 3 woven by the loom needles form perpendicular loops between the meshes of the adjacent mesh chains 4. In contrast to the above, in the mesh 1 the bond is weft, i.e. the weft yarn or band 3 never form a loop since the weft yarn or band 3 is only inserted between the meshes of the mesh chains 4 without the hooks of the loom needles intervening in this type of bond.

Figure 3:
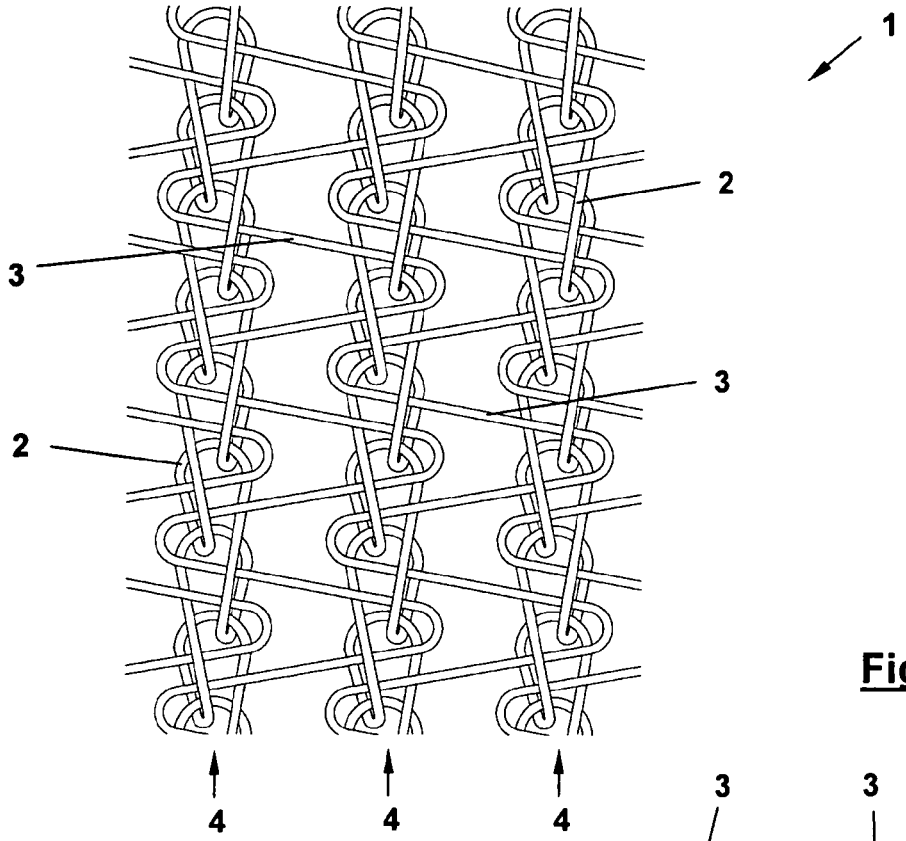
FIG. 3 is a cutaway view of the mesh of FIG. 2.

In FIG. 3, the detail of the interweaving of two weft yarns or bands 3 between three adjacent mesh chains 4 constituted by respective warp yarns or bands 2 has been enlarged. It is observed that the meshes of all the mesh chains 4 have the same configuration and are aligned at the same level with respect to the meshes of the adjacent mesh chains 4, without there being any gap. For its part, a mesh chain 4 is associated or joined to the two adjacent mesh chains 4 it has at each side via the interweaving of the respective weft yarns or bands 3 which are inserted between the meshes of the mesh chain 4 and those of the mesh chain 4 adjacent thereto.

As a result of the aforementioned structure of yarns or bands 2 and 3, a uniform tubular mesh 1 is obtained without longitudinal seams or perpendicular mesh bonds throughout the structure.

FIG. 3 shows that each weft yarn or band 3 is interwoven between two adjacent mesh chains 4 traversing the meshes positioned at the same level of said adjacent mesh chains 4, after which the weft yarn or band 3 rotates to traverse the meshes of the level immediately above that of said adjacent mesh chains 4.

Figure 4:
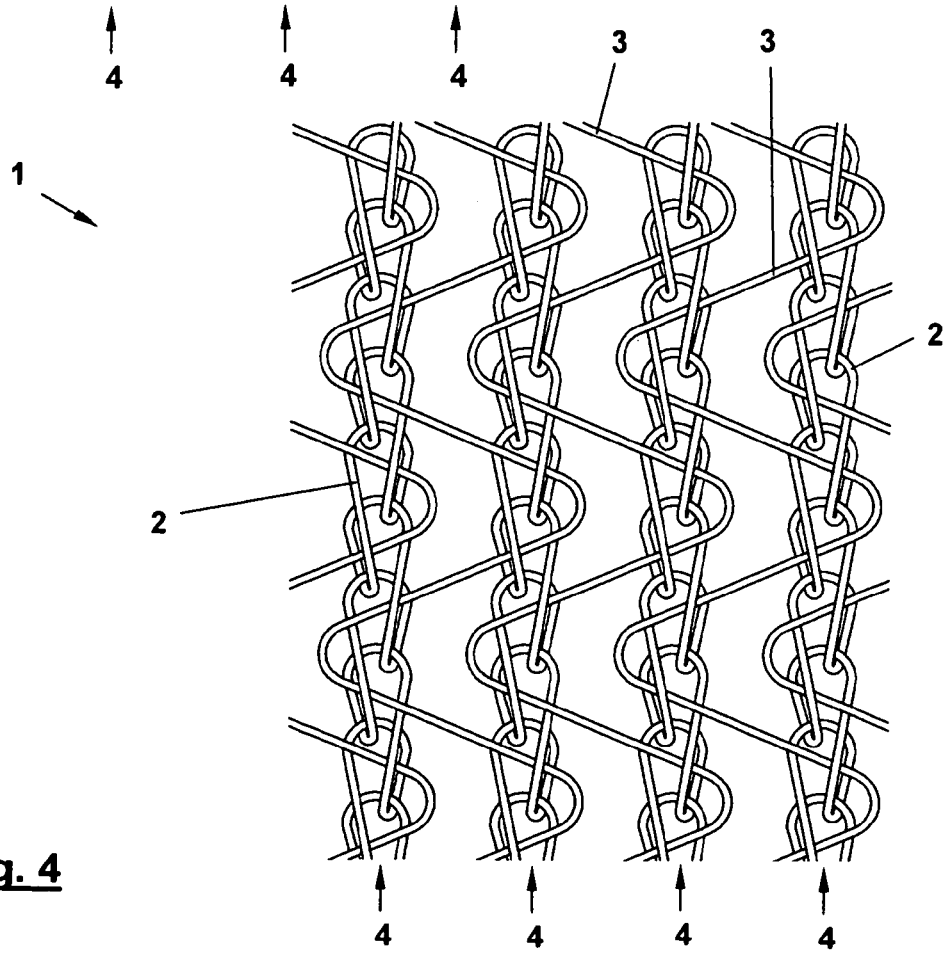
FIGS. 4, 5 and 6 are different cutaway views of respective embodiments of the invention.

In FIG. 4, each weft yarn or band 3 is also interwoven between two adjacent mesh chains 4, but unlike the mesh 1 of FIG. 3, each weft yarn or band 3 is interwoven traversing the meshes with a one level gap between them from the mesh chains 4, i.e. between two rotations of the weft yarn or band 3, this is interwoven between the two adjacent mesh chains 4 traversing a mesh of a mesh chain 4 with the mesh of the level immediately above the adjacent mesh chain 4.

Figure 5:
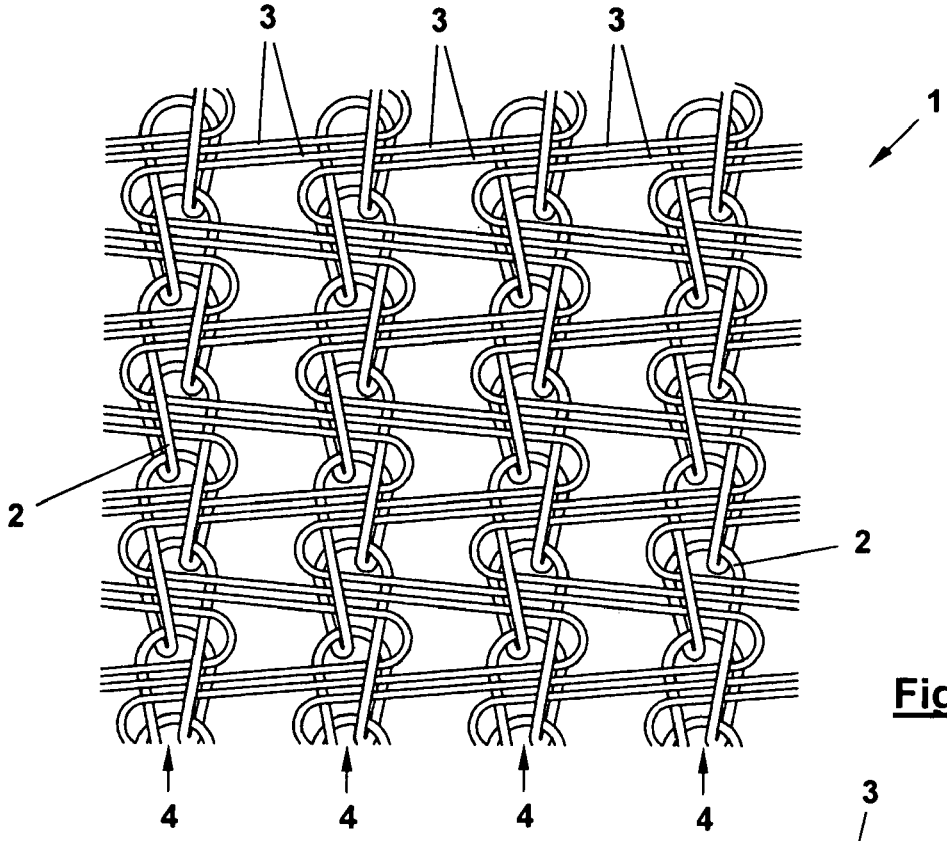
Figure 6:
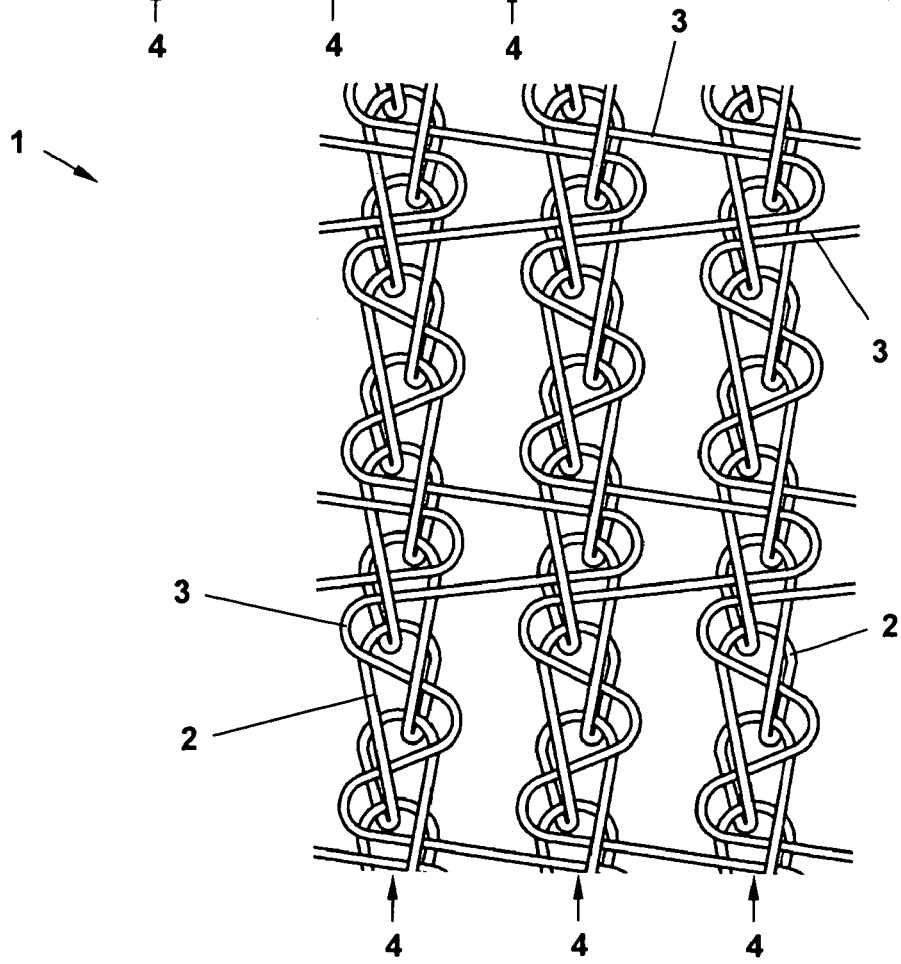

Unlike the mesh 1 of FIGS. 4 and 5, in the mesh 1 of FIG. 6 the weft yarn or band 3 is interwoven traversing several adjacent meshes of a same mesh chain 4, i.e. several meshes positioned at adjacent levels, until it traverses the meshes of the adjacent mesh chain 4.

It should be mentioned that the interweaving performed by each weft yarn or band 3 does not have to be limited to two adjacent mesh chains 4, but it can be inserted between the meshes of three, four or more adjacent mesh chains 4.

Thus, in FIG. 5 each weft yarn or band 3 is interwoven between three adjacent mesh chains 4.

Furthermore, the warp yarns or bands 2 of the mesh chains 4 may have characteristics and physical properties different to those of the weft yarns or bands 3. In this way, according to the product to be contained within the bag or packaging produced with the tubular mesh 1, the mesh 1 can be produced with warp yarns or bands 2 and weft yarns or bands 3 with different degrees of elasticity and elongation to tearing, being able to vary the degree of compression exerted longitudinally and transversally by the mesh 1 on the packaged product as desired.

In addition to the aforementioned, the warp yarns or bands 2 of the mesh chains 4 may be made of a different material from the material of the weft yarns or bands 3, depending on the functional and/or aesthetic requirements of the bag or packaging to be manufactured. For example, from an aesthetic point of view, if the weft yarn or band 3 is made of a transparent material, only the vertical lines which form the mesh chains 4 of the warp yarns or bands 2 are visible in the tubular mesh 1 obtained. By contrast, if one wants to highlight the zigzag shape of the mesh bag or packaging 1, it will be the warp yarn 2 which will be made of transparent material.

The bag or the packaging obtained from the tubular mesh 1 allows a saving both in the use of material for the mesh and in the manufacturing process thereof, as to join or associate the mesh chains 4 of the warp yarns or bands 2 it is not necessary for the needles to weave the weft yarns or bands 3 so that they bind the meshes forming loops between the mesh chains 4, but it is sufficient to interweave the weft yarn or band 3 between one or several adjacent mesh chains 4 without the loom needle hooks playing any part.

The invention claimed is:

1. Mesh (1) for bags or packaging, characterized in that it is produced by knitting technology by warping in a circular loom of simultaneous mesh formation, forming a uniform tubular mesh structure wherein the warp yarns or bands (2) form mesh chains (4) parallel to the longitudinal axis of the tubular mesh and the weft yarns or bands (3) perpendicular to said axis are interwoven in zigzag between at least two adjacent mesh chains so that each weft yarn or band traverses the meshes of said chains in alternating directions, constituting a uniform tubular mesh without longitudinal seams or perpendicular mesh bonds throughout the structure.

2. Mesh (1) for bags or packaging according to claim 1, characterized in that the warp yarns or bands (2) of the mesh chains (4) have characteristics and physical properties different to those of the weft yarns or bands (3).

3. Mesh (1) for bags or packaging according to claim 1, characterized in that the warp yarns or bands (2) of the mesh chains (4) are made of a material different to the material of the weft yarns or bands (3).

4. Mesh (1) for bags or packaging according to claim 2, characterized in that the warp yarns or bands (2) of the mesh chains (4) are made of a material different to the material of the weft yarns or bands (3).

5. The mesh for bags or packaging according to claim 1, wherein the number of warp yarns or bands is the same as the number of weft yarns or bands.

6. The mesh for bags or packaging according to claim 5, wherein the warp yarns or bands of the mesh chains have characteristics and physical properties different from those of the weft yarns or bands.

7. The mesh for bags or packaging according to claim 5, wherein the warp yarns or bands of the mesh chains are made of a material different to the material of the weft yarns or bands.

8. The mesh for bags or packaging according to claim 6, wherein the warp yarns or bands of the mesh chains are made of a material different to the material of the weft yarns or bands.

9. A woven mesh, comprising, warp lines that form generally parallel warp mesh chains;

weft lines that are interwoven with the warp mesh chains in a zigzag manner so as to traverse the warp mesh chains in alternating directions, wherein the mesh is a uniform tubular structure formed by weaving on a circular loom, and wherein the tubular mesh is without longitudinal seams or perpendicular mesh bonds throughout the structure.

10. The mesh according to claim 9, wherein the number of warp lines is the same as the number of weft lines.

11. The mesh according to claim 9, wherein the warp mesh chains are generally parallel to a symmetrical axis of the tubular structure and each warp mesh chain is aligned, in a direction of the symmetrical axis, with immediately adjacent warp mesh chains.

12. The mesh according to claim 9, wherein each of the weft lines is interwoven with the warp mesh chains in a zigzag manner without looping over itself.

13. The mesh according to claim 9, wherein each stitch of the warp mesh chains is interwoven with a weft line.

14. The mesh according to claim 9, wherein the warp line have physical properties different from those of the weft lines.

15. The mesh according to claim 9, wherein the warp lines are made of a different material than the weft lines.

16. The mesh according to claim 9, wherein each weft line is interwoven between two adjacent warp mesh chains so as to traverse a mesh of one of the two adjacent warp mesh chains at a same level that the weft line traverses a mesh of the other of the two adjacent warp mesh chains, after which the weft line rotates to traverse meshes of the two adjacent warp mesh chains that are immediately above.

17. The mesh according to claim 9, wherein each weft line is interwoven between two adjacent warp mesh chains so as to traverse a mesh of one of the two adjacent warp mesh chains at a level immediately below a level that the weft line traverses a mesh of the other of the two adjacent warp mesh chains, after which the weft line rotates to traverse subsequent meshes of the two adjacent warp mesh chains in a same manner.

18. The mesh according to claim 9, wherein each weft line traverses no more than two adjacent mesh chains before turning back.

19. The mesh according to claim 9, wherein each weft line traverses no more than three adjacent mesh chains before turning back.

20. The mesh according to claim 9, wherein the weft line is interwoven so as to traverse more than one mesh of a same mesh chain, before traversing a mesh of another mesh chain.

21. The mesh according to claim 9, wherein each mesh chain is linked to at least an adjacent warp mesh chain on one side of said mesh chain and another adjacent warp mesh chain on an opposite side of said mesh chain.

* * * * *